US010286263B2

(12) United States Patent
Ivanova et al.

(10) Patent No.: US 10,286,263 B2
(45) **Date of Patent: *May 14, 2019**

(54) IRON-TYPE GOLF CLUB HEAD WITH LIGHTWEIGHT HOSEL

(71) Applicant: Callaway Golf Company, Carlsbad, CA (US)

(72) Inventors: Irina Ivanova, San Marcos, CA (US); Joshua D. Westrum, Vista, CA (US); Scott R. Manwaring, Carlsbad, CA (US); Matthew T. Cackett, San Diego, CA (US); Brooks Roche, Ramona, CA (US); Bradley C. Rice, Carlsbad, CA (US); William C. Watson, Temecula, CA (US); Sean P. Griffin, Grand Haven, MI (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/866,137

(22) Filed: Jan. 9, 2018

(65) Prior Publication Data

US 2018/0126229 A1 May 10, 2018

Related U.S. Application Data

(60) Division of application No. 15/209,617, filed on Jul. 13, 2016, now Pat. No. 9,861,863, which is a (Continued)

(51) Int. Cl.

*A63B 53/04* (2015.01)
*A63B 53/02* (2015.01)

(Continued)

(52) U.S. Cl.

CPC ..... *A63B 53/02* (2013.01); *A63B 53/047* (2013.01); *A63B 60/02* (2015.10); *A63B 60/50* (2015.10);

(Continued)

(58) Field of Classification Search

CPC . A63B 53/02; A63B 53/047; A63B 2053/042; A63B 2053/0408; A63B 60/02;

(Continued)

(56) References Cited

U.S. PATENT DOCUMENTS 1,480,056 A * 1/1924 Flint ..... A63B 53/02 473/309
4,630,825 A * 12/1986 Schmidt ..... A63B 53/04 473/287

(Continued)

*Primary Examiner* — Stephen L Blau
(74) *Attorney, Agent, or Firm* — Rebecca Hanovice; Michael Catania; Sonia Lari

(57) ABSTRACT

The present invention relates to an iron-type golf club head having a lightweight hosel and a high, toe-ward located center of gravity. The golf club head preferably includes a hollow body with a hosel and an interior mold line that extends into the hosel and is separated from a shaft bore by a solid barrier that does not include any through-holes. An upper portion of the body may include a pocket to hold a high-density weight, and the hosel wall may include multiple through-bores to further lighten the hosel. The golf club head may also include one or more internal ribs extending from the hollow interior of the body into the interior of the hosel.

10 Claims, 9 Drawing Sheets

Related U.S. Application Data continuation-in-part of application No. 15/192,574, filed on Jun. 24, 2016, now Pat. No. 9,849,349, and a continuation-in-part of application No. 14/858,891, filed on Sep. 18, 2015, now Pat. No. 9,526,953, which is a division of application No. 14/072,055, filed on Nov. 5, 2013, now abandoned, which is a continuation of application No. 13/104,675, filed on May 10, 2011, now abandoned.

(60) Provisional application No. 61/333,992, filed on May 12, 2010.

(51) Int. Cl.
*A63B 60/02* (2015.01)
*A63B 60/50* (2015.01)

(52) U.S. Cl.
CPC ..... *A63B 2053/0408* (2013.01); *A63B 2053/0491* (2013.01); *A63B 2209/00* (2013.01)

(58) Field of Classification Search
CPC ..... A63B 60/50; A63B 2209/00; A63B 2053/0491
See application file for complete search history.

(56) References Cited

U.S. PATENT DOCUMENTS

| | | | | |
|---|---|---|---|---|
| 5,324,033 | A * | 6/1994 | Fenton, Jr. | A63B 60/00 473/305 |
| 5,676,605 | A * | 10/1997 | Kobayashi | A63B 53/04 473/331 |
| 5,711,722 | A * | 1/1998 | Miyajima | A63B 53/04 473/346 |
| 5,908,357 | A * | 6/1999 | Hsieh | A63B 53/04 473/327 |
| 6,561,921 | B2 * | 5/2003 | Takeda | A63B 53/02 473/305 |
| 6,780,123 | B2 * | 8/2004 | Hasebe | A63B 53/04 473/291 |
| 6,923,733 | B2 * | 8/2005 | Chen | A63B 53/047 473/305 |
| 7,090,590 | B2 * | 8/2006 | Chen | A63B 53/02 473/324 |
| 7,273,419 | B2 * | 9/2007 | Evans | A63B 53/0466 473/328 |
| 7,722,479 | B2 * | 5/2010 | Soracco | A63B 53/047 473/350 |
| 7,819,757 | B2 * | 10/2010 | Soracco | A63B 53/04 473/332 |
| 7,955,188 | B2 * | 6/2011 | Bennett | A63B 53/02 473/324 |
| 2018/0243619 | A1 * | 8/2018 | Ines | B21K 17/00 |

* cited by examiner

IRON-TYPE GOLF CLUB HEAD WITH LIGHTWEIGHT HOSEL

CROSS REFERENCES TO RELATED APPLICATIONS

The present application is a divisional of U.S. patent application Ser. No. 15/209,617, filed on Jul. 13, 2016, and issued on Jan. 9, 2018, as U.S. Pat. No. 9,861,863, which is a continuation-in-part of U.S. patent application Ser. No. 15/192,574, filed on Jun. 24, 2016, and issued on Dec. 26, 2017, as U.S. Pat. No. 9,849,349, and also is a continuation-in-part of U.S. patent application Ser. No. 14/858,891, filed on Sep. 18, 2015, which is a divisional of U.S. patent application Ser. No. 14/072,055, filed on Nov. 5, 2013, now abandoned, which is a continuation of U.S. patent application Ser. No. 13/104,675, filed on May 10, 2011, now abandoned, which claims priority to U.S. Provisional Patent Application No. 61/333,992, filed on May 12, 2010.

STATEMENT REGARDING FEDERALLY SPONSORED RESEARCH OR DEVELOPMENT

Not Applicable

BACKGROUND OF THE INVENTION

Field of the Invention

The present invention relates generally to a golf club head with a lightweight hosel and a center of gravity located above its geometric face center and close to its toe.

Description of Related Art

The USGA Rules of Golf limit set forth certain structural limits for conforming golf clubs. For example, Appendix II, Rule 2(c) states that, for non-putter clubs, a "shaft must be attached to the clubhead at the heel either directly or through a single plain neck and/or socket. The length from the top of the neck and/or socket to the sole of the club must not exceed 5 inches (127 mm), measured along the axis of, and following any bend in, the neck and/or socket."

In view of these requirements, the hosel centers great deal of mass in the heel of the golf club head, particularly in iron-type golf club heads, which typically have smaller volumes than wood-type heads and require greater structural support at the hosel. There is a need to reduce the mass in the hosel region of iron-type golf club heads to increase the amount of discretionary mass available to a golf club manufacturer, move the center of gravity of the golf club head away from the heel, and thereby make such iron-type golf club heads more forgiving to golfers.

Furthermore, golf club hosels typically are cylindrical in cross section and are consistent in width, which provides support for the shaft but resists bending and concentrates mass on the heel side of the club head. Adjustable hosels currently are very popular among golfers, so there is a need to provide golf club hosels that can be adjusted or bent to change the angle of the shaft with respect to the golf club head without sacrificing structural integrity.

BRIEF SUMMARY OF THE INVENTION

The present invention relates to a golf club head having a lightweight hosel, and particularly an iron-type golf club head with a center of gravity located on a toe side of the geometric center of the face along a horizontal Y axis and an interior mold line that extends into the hosel and is separated from a shaft bore by a barrier.

One aspect of the present invention is an iron-type golf club head comprising a body comprising a top portion, a bottom portion, a heel portion, a toe portion, and a rear portion, a hosel comprising, a tube body comprising a tube wall, a bore, a barrier, and a flange section located below the tube body at an interface between the body and the hosel, wherein the top portion, bottom portion, heel portion, toe portion, and rear portion define a hollow interior having an interior mold line, wherein the bore has a length of at least one inch and is disposed entirely within the tube body, wherein the interior mold line extends into the tube body above the flange section, wherein the barrier is disposed between and separates the bore and the interior mold line, and wherein the barrier does not comprise any through-holes. In some embodiments, a wire mesh filler may be disposed within the hollow interior proximate the hosel. In other embodiments, the golf club head may comprise at least one rib, which may be disposed within the hollow interior and extend into the tube body above the flange section. In a further embodiment, the at least one rib may comprise first and second, intersecting, ribs, one of which may be disposed at or above the flange section.

In some embodiments, the golf club head may comprise a face component, the body may comprise a front opening and a heel edge, which may be disposed at the flange section, and the face component may close the front opening. In other embodiments, the golf club head may further comprise a high density insert, and the body may comprise a pocket sized to receive the high density insert. In further embodiments, the pocket may be disposed in the rear portion of the body, and the golf club head may be a wedge-type golf club head. In other embodiments, the pocket may be disposed in the toe portion of the body. In any of the embodiments disclosed herein, the tube body may comprise a first width proximate an upper edge of the tube body and a second width proximate the barrier, and the tube body width may taper gradually from the first width to the second width. In a further embodiment, the first width may be approximately 0.50 inch and the second width may be approximately 0.47 inch.

In some embodiments, the barrier may have a thickness of approximately 0.040 inch, the flange section may have a thickness of 0.020 to 0.050 inch, and the hosel may be integrally formed with the head body. In a further embodiment, the golf club head may comprise a hosel cover sized to close an opening in the tube wall of the hosel, the body and the hosel may be composed of a first material having a first density, the hosel cover may be composed of a second material having a second density, and wherein second density may be lower than the first density. In a further embodiment, each of the first and second materials may be a metal alloy. In any of the embodiments disclosed herein, the tube wall may comprise a plurality of through-bores.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention relates to a golf club head having a lightweight hosel with a variable cross-sectional diameter that is thick enough to withstand golf club swing and impact loads, and thin enough to bend without distorting other structural features of the golf club. In particular, the present invention relates to iron-type golf club heads, which traditionally have more mass located in their heel sides due to the dimensions of the head and the manufacturing limitations associated with creating those dimensions.

Figure 1:
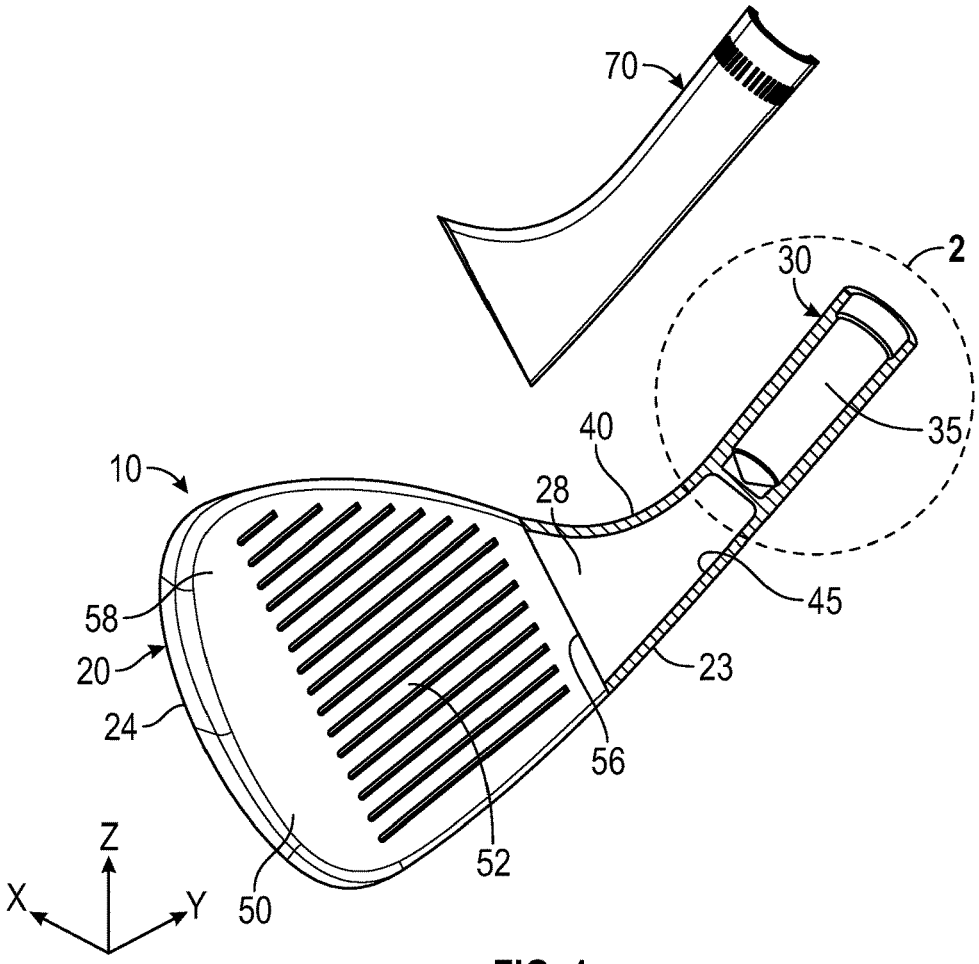
FIG. 1 is an exploded view of a golf club head according to a first embodiment of the present invention.
Figure 2:
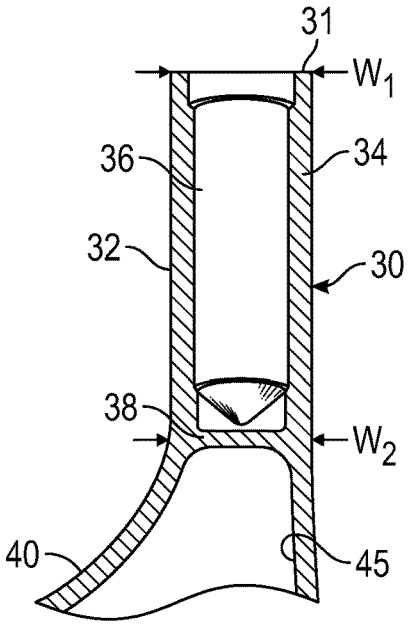
FIG. 2 is an enlarged view of the circled portion of the embodiment shown in FIG. 1.

In the preferred embodiment, shown in FIGS. 1 and 2, the golf club head 10 has a body 20 having a top portion 21, a bottom portion 22, a heel side 23, a toe side 24, a rear side 25, a front opening 26, and a hollow interior 28 defined by the other portions of the body 20 and by the face component 50. The face component 50 preferably comprises a striking surface 52 that does not include a bulge or a roll, a rear surface 54 opposite the striking surface 52, a heel side 56, and a toe side 58, and the heel side 56 abuts a heel edge portion 27 of the body 20. The hollow interior 28 is delineated by the interior mold line (IML) 45 of the body 20, and preferably extends past the flange section 40 (the transition between the body 20 and the hosel 30) into the hosel 30. The flange section 40 is defined as the region where the body 20 stops tapering downward in size and meets the tube body 32 of the hosel 30, and preferably has a wall thickness of 0.020 to 0.050 inch.

The hosel 30 extends from the flange section 40 at the heel side 23 of the body 20, and includes a tube body 32 having a wall 34, a bore 36 into which a shaft (not shown) can be inserted and fixed, and a solid barrier 38 against which the bottom of the shaft rests when engaged with the bore 36. The barrier 38, which preferably has a thickness ranging from 0.020 to 0.040 inch, does not include any through holes, and separates the shaft from the hollow interior 28 of the body 20. In addition to providing the hosel 30 with additional rigidity, the barrier 38 prevents debris and glue from entering the heel portion 29 of the hollow interior 28 via the bore 36. The bore 36 preferably has a depth of at least one inch and is designed so that the hosel 30 includes the least amount of material as possible, which decreases the overall weight of the club head. In other words, it is beneficial to have a hosel 30 with a large bore 36 IML. As shown in FIG. 2, the width of the tube body 32 gently changes or tapers from a maximum width $W_1$ at the top end 31 to a minimum width $W_2$ encircling the barrier 38, which reduces the overall mass of the hosel 30 and improves its bendability without undermining its overall structural integrity. $W_1$ preferably is approximately 0.50 inch and $W_2$ preferably is approximately 0.47 inch.

Figure 3:
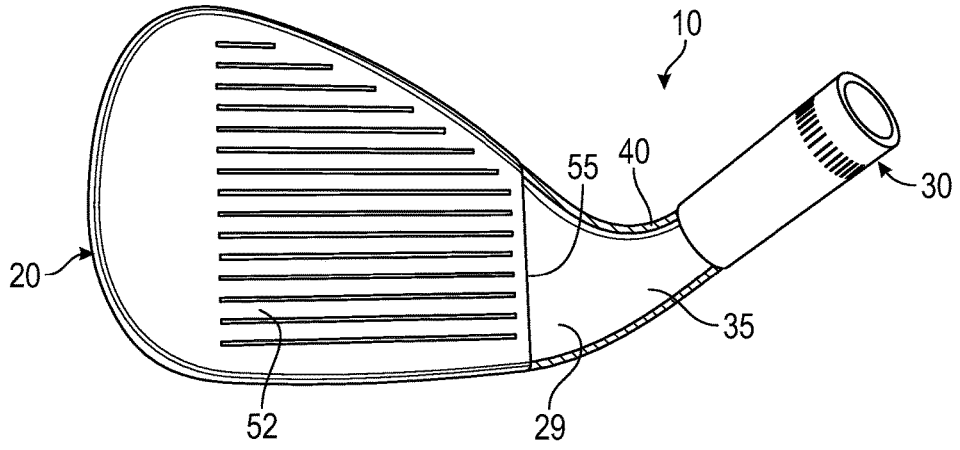
FIG. 3 is a front elevational view of a golf club head according to a second embodiment of the present invention.
Figure 4:
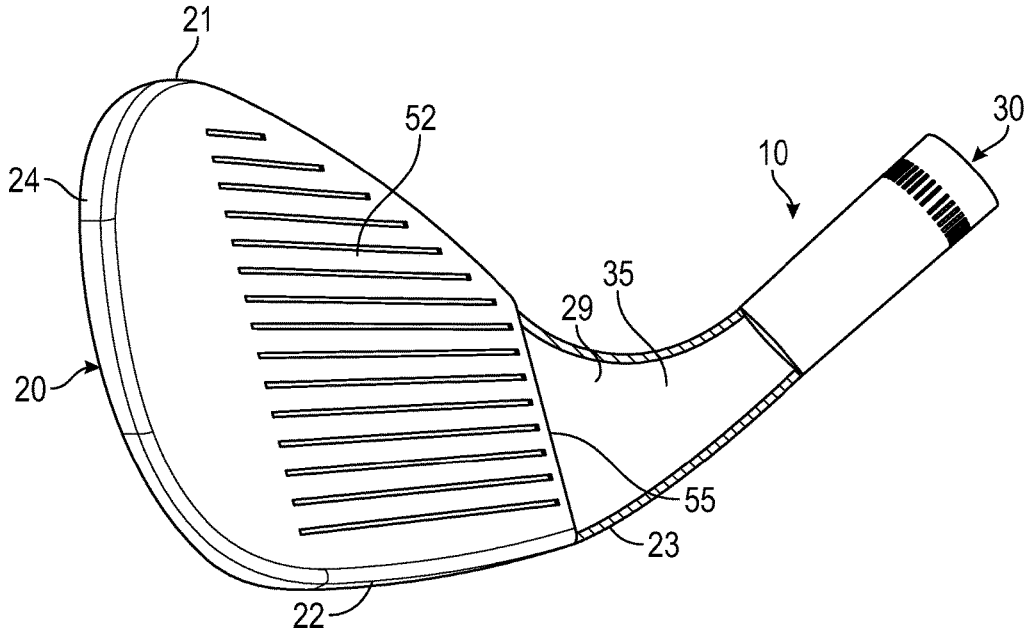
FIG. 4 is a front perspective view of the embodiment shown in FIG. 3.
Figure 5:
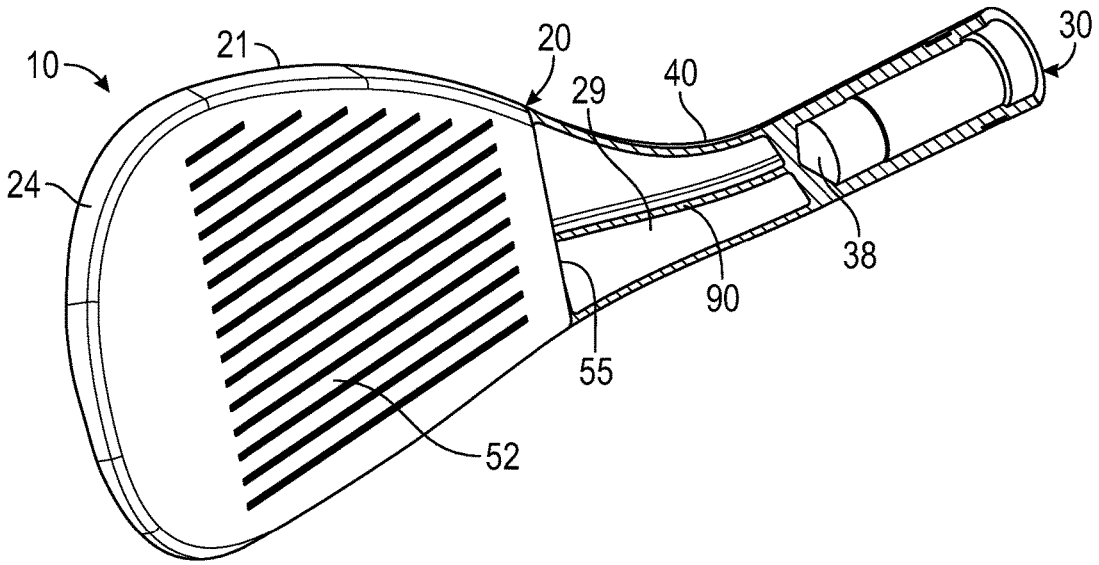
FIG. 5 is a side elevational view of a golf club head according to a third embodiment of the present invention.
Figure 6:
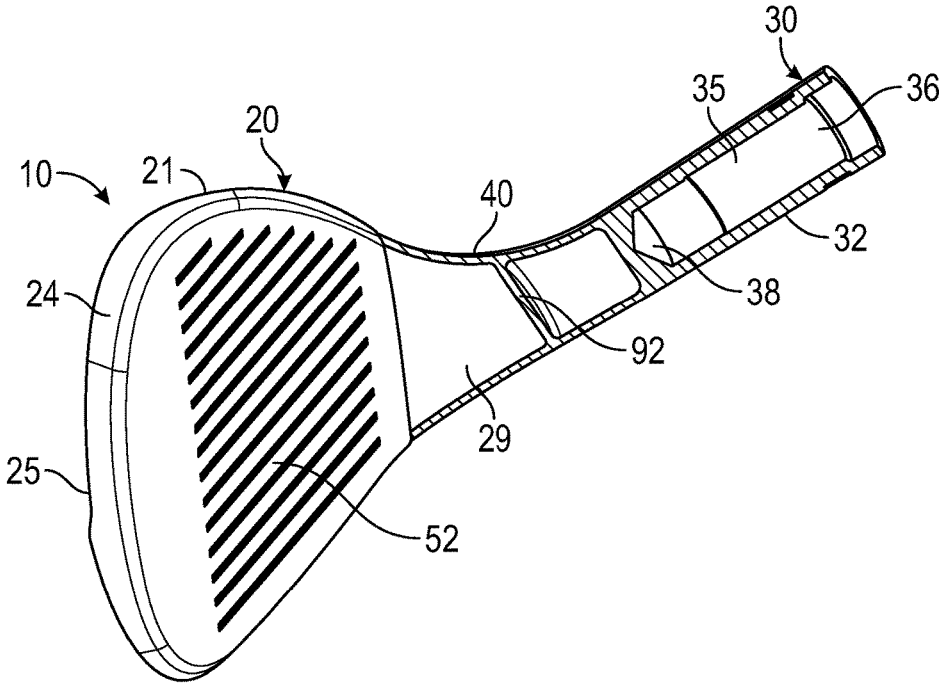
FIG. 6 is a side elevational view of a golf club head according to a fourth embodiment of the present invention.
Figure 7:
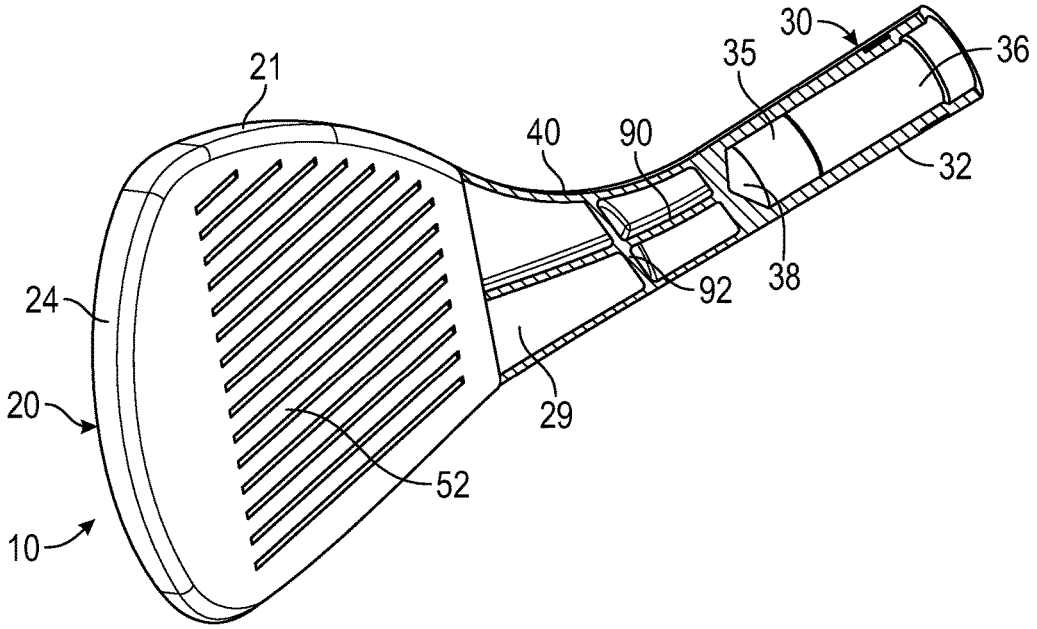
FIG. 7 is a side elevational view of a golf club head according to a fifth embodiment of the present invention.
Figure 8:
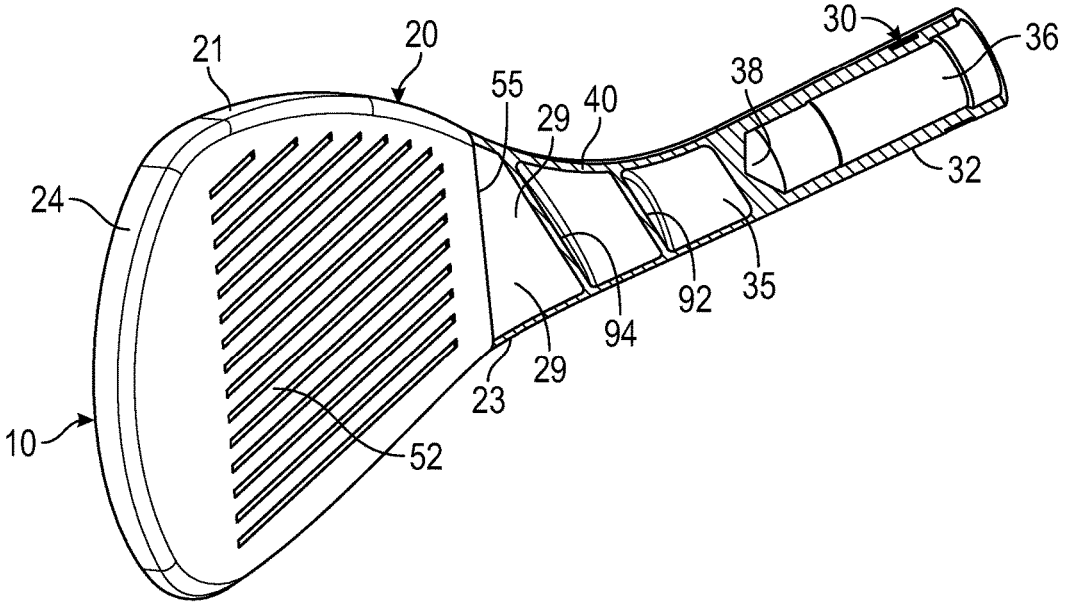
FIG. 8 is a side elevational view of a golf club head according to a sixth embodiment of the present invention.
Figure 9:
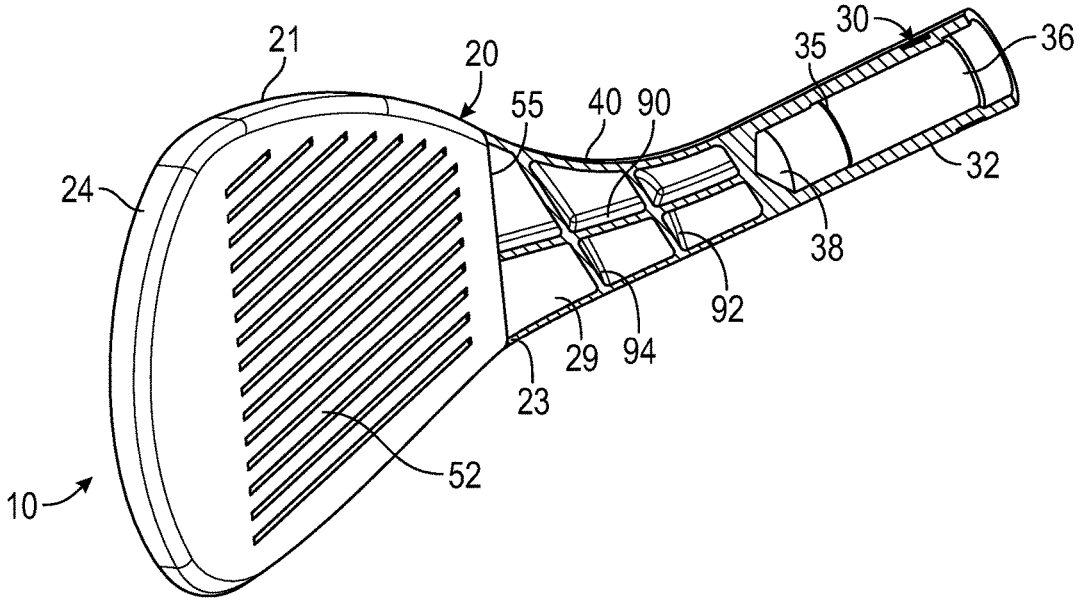
FIG. 9 is a side elevational view of a golf club head according to a seventh embodiment of the present invention.

As shown in FIG. 1, the hosel 30 of the preferred embodiment also includes a large cutout portion 35, which extends along the entire length of the hosel 30 up to the heel edge portion 27 of the body 20. In an alternative embodiment, shown in FIGS. 3 and 4, the cutout portion 35 extends only from the heel edge portion 27 to a location proximate the barrier 38. The cutout portion 35 preferably is located in a front-most side of the hosel 30 to move mass, and thus the center of gravity, rearward on the golf club head 10. The cutout portion 35 is covered with a hosel cover 70 made from a material having a lower density than that of the hosel 30, and preferably from a lighter-weight metal alloy such as aluminum or magnesium, that can be welded to the hosel 30. If the hosel cover 70 is made from a non-metal material such as carbon composite or plastic, it can be bonded to the body 20 with a permanent adhesive.

The preferred embodiment preferably has a mass of 220-320 grams, a center of gravity depth along an X axis of 0.010 to 0.350 inch, and a loft angle, defined as the angle at which the striking surface 52 lies relative to the shaft, of at least 16 degrees. The bottom portion 22 of the golf club head 10 preferably has a front-to-back length along the X axis of less than 1.5 inches, and the body 20 and hosel 30 preferably are integrally cast, or otherwise manufactured, as a unitary piece, though in alternative embodiments the hosel 30 may be welded or otherwise affixed to the body 20 after each part is separately manufactured. In the preferred embodiment, the face component 50 is manufactured separately from the body 20, and is composed of a different material than the body 20. In particular, the face component 50 is composed of a titanium alloy, such as 6-4 or 811 titanium, while the body 20 is composed of a steel material, such as 17-4, 450, 475, 1020, or 1025 steel, and the face component 50 is brazed to the body 20 to close the front opening 26.

In other embodiments, the portion of the IML 45 that extends into the tube body 32 is structurally supported by one or more internal ribs 90, 92, 94 extending from the hollow interior 28 of the body 20 past the flange section 40 and into the tube body 32, as shown in the embodiments of FIGS. 5-9. For example, in FIG. 5, a single rib 90 extends from the heel portion 29 of the hollow interior 28, preferably a location proximate the heel edge portion 27 or heel side 56 of the face component 50, and into the tube body 32, where it terminates at or proximate the barrier 38. In an alternative embodiment, shown in FIG. 6, a single rib 92 is disposed within the golf club head 10 proximate the flange section 40. In the embodiment shown in FIG. 7, the golf club head 10 includes both ribs 90, 92 shown in FIGS. 5 and 6, such that the ribs 90, 92 intersect with one another. In the embodiment shown in FIG. 8, two ribs 92, 94 extend parallel to one another within the golf club head 10 on either side of the flange section 40, and in the embodiment shown in FIG. 9, the two ribs 92, 94 are intersected by the elongated rib 90 extending from the heel portion 29 of the hollow interior 28 of the body 20 into the tube body 32 of the hosel 30. The ribs 90, 92, 94 disclosed herein preferably are thick enough to provide support for the hosel 30 without adding too much mass to the golf club head 10.

Figure 10:
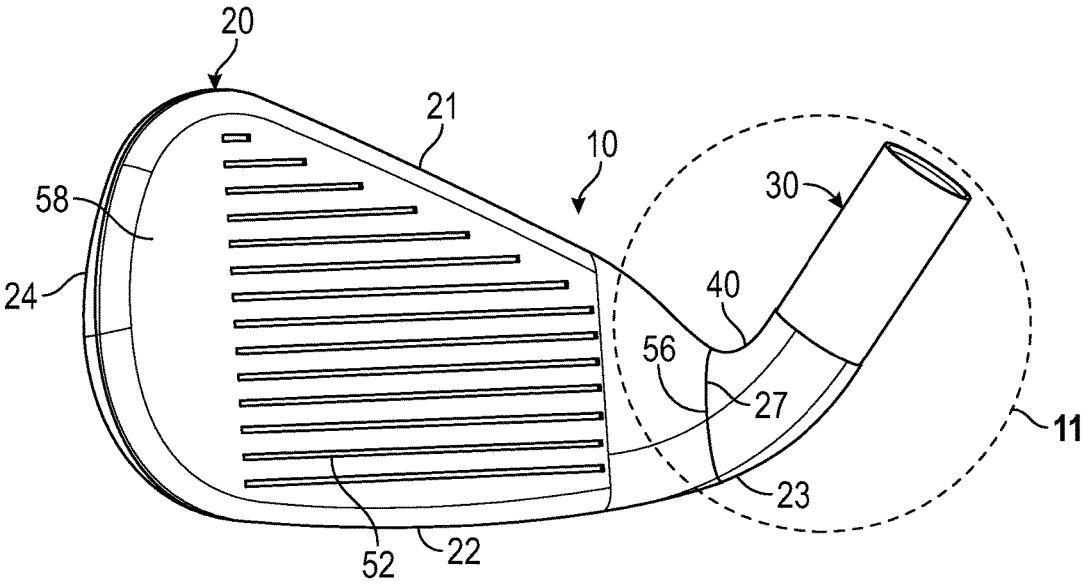
FIG. 10 is a front elevational view of a golf club head according to an eighth embodiment of the present invention.
Figure 11:
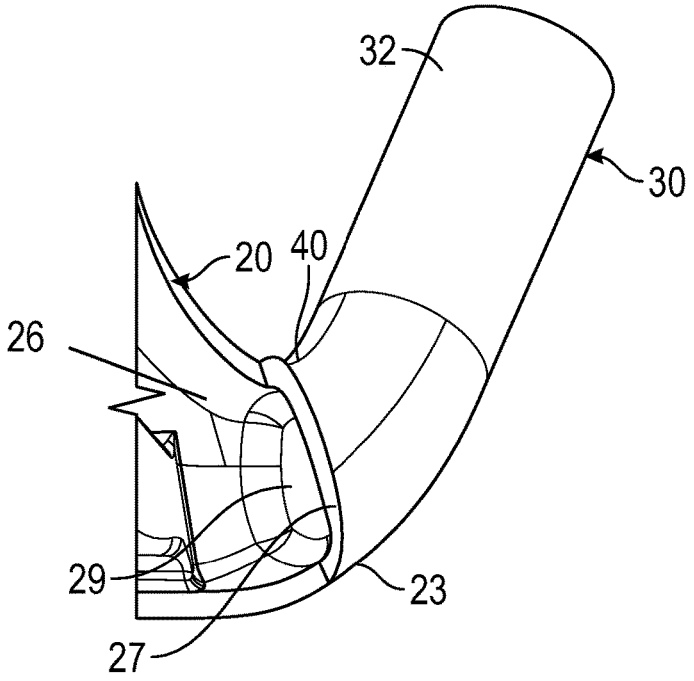
FIG. 11 is an enlarged view of the circled portion of the embodiment shown in FIG. 10 without its face component.

In another embodiment of the present invention, shown in FIGS. 10 and 11, the hosel 30 and heel side 23 of the golf club head 10 are further lightened by moving the heel edge portion 27, and thus the heel side 56 of the face component 50, further towards the hosel 30 tube body 32, such that it is located at, or close to, the flange section 40. If the face component 50 is composed of a lighter weight or lower density material than that of the body 20, this construction frees up additional discretionary mass and moves that mass away from the heel side 23 of the golf club head 10.

Figure 12:
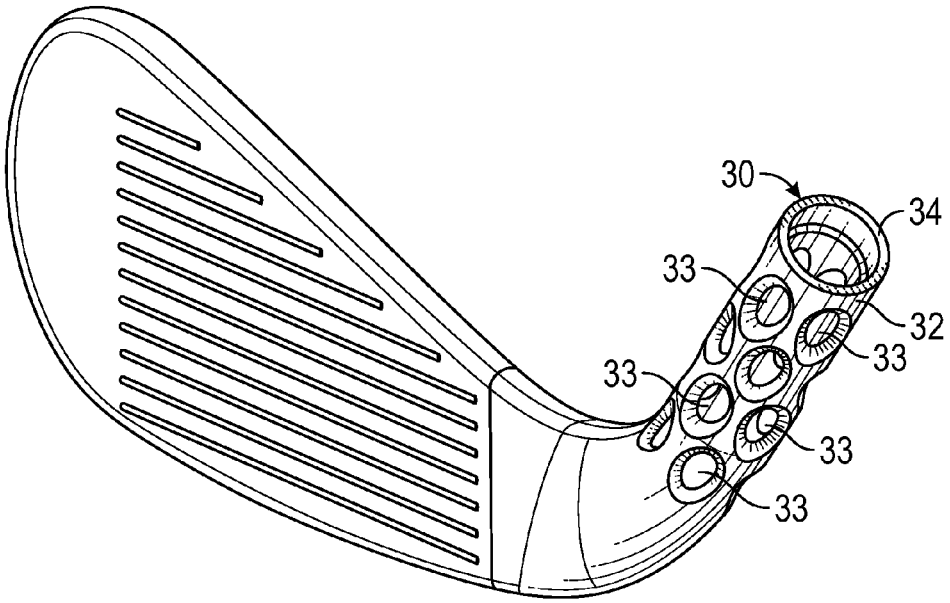
FIG. 12 is a side elevational view of a golf club hosel according to a ninth embodiment of the present invention.

In another embodiment of the present invention, an example of which is shown in FIG. 12, the hosel 30 includes a plurality of geometric through-holes 33 extending through the wall 34 of the tube body 32. The tube body 32 may include any of the through-holes 33 disclosed in U.S. Design patent application Ser. No. 29/566,666, filed on Jun. 1, 2016, the disclosure of which is hereby incorporated by reference in its entirety herein, or any combinations thereof.

Figure 13:
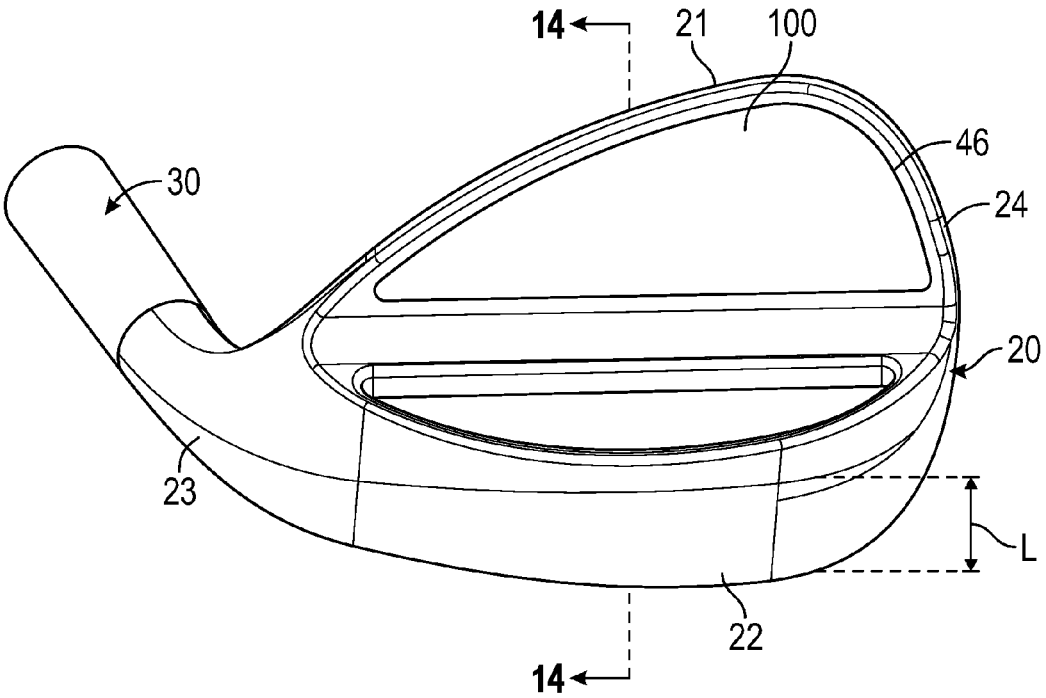
FIG. 13 is a rear elevational view of a golf club head according to a tenth embodiment of the present invention.
Figure 14:
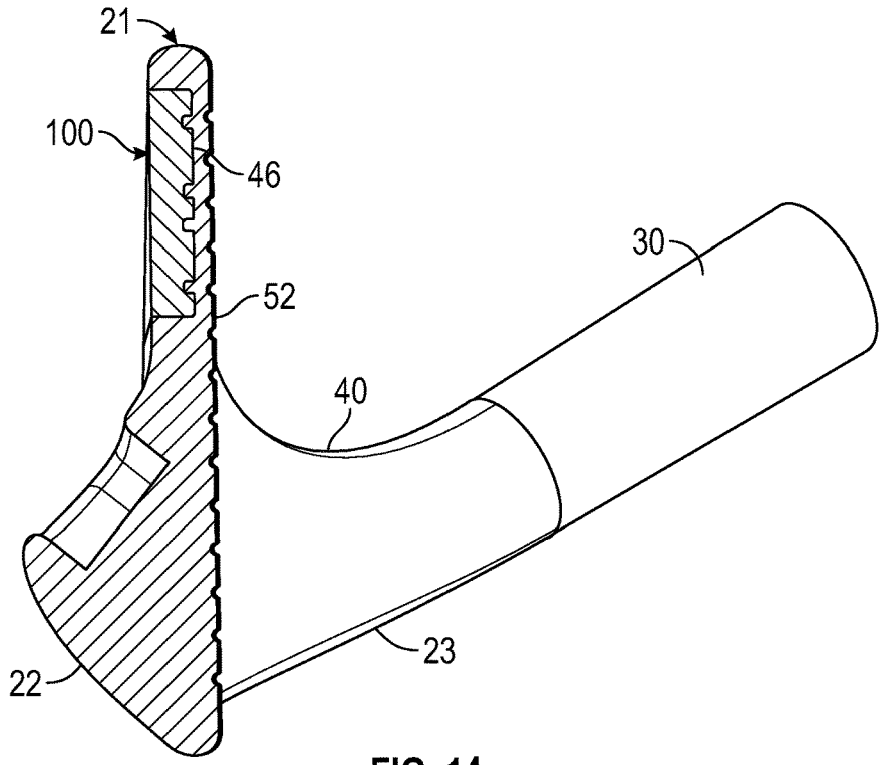
FIG. 14 is a cross-sectional view of the embodiment shown in FIG. 13 along lines 14-14.

As discussed herein, the hosel lightening concepts of the present invention serve at least two purposes: (1) moving mass away from the heel side 23 of the golf club head 10; and (2) moving the center of gravity rearward along the x axis, toe-ward along the y axis, and upward along the z axis. The second goal can be aided by the addition of a high-density insert 100 to the body 20, as shown in FIGS. 13-14. In this embodiment, the body 20 includes a pocket 46, which preferably extends into the rear side 25 at a location close to the top portion 21 and/or the toe side 24, sized to permanently or removably receive the high-density insert 100, which preferably is composed of a tungsten alloy.

Figure 15:
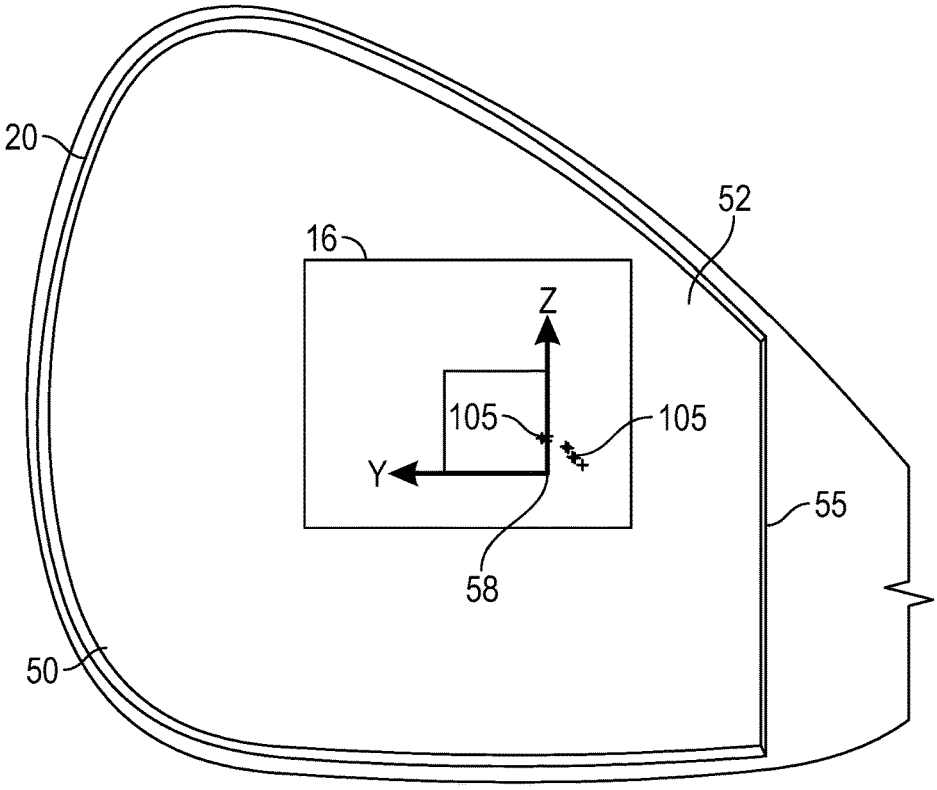
FIG. 15 is a front plan view of any of the embodiments shown in FIGS. 1-14.
Figure 16:
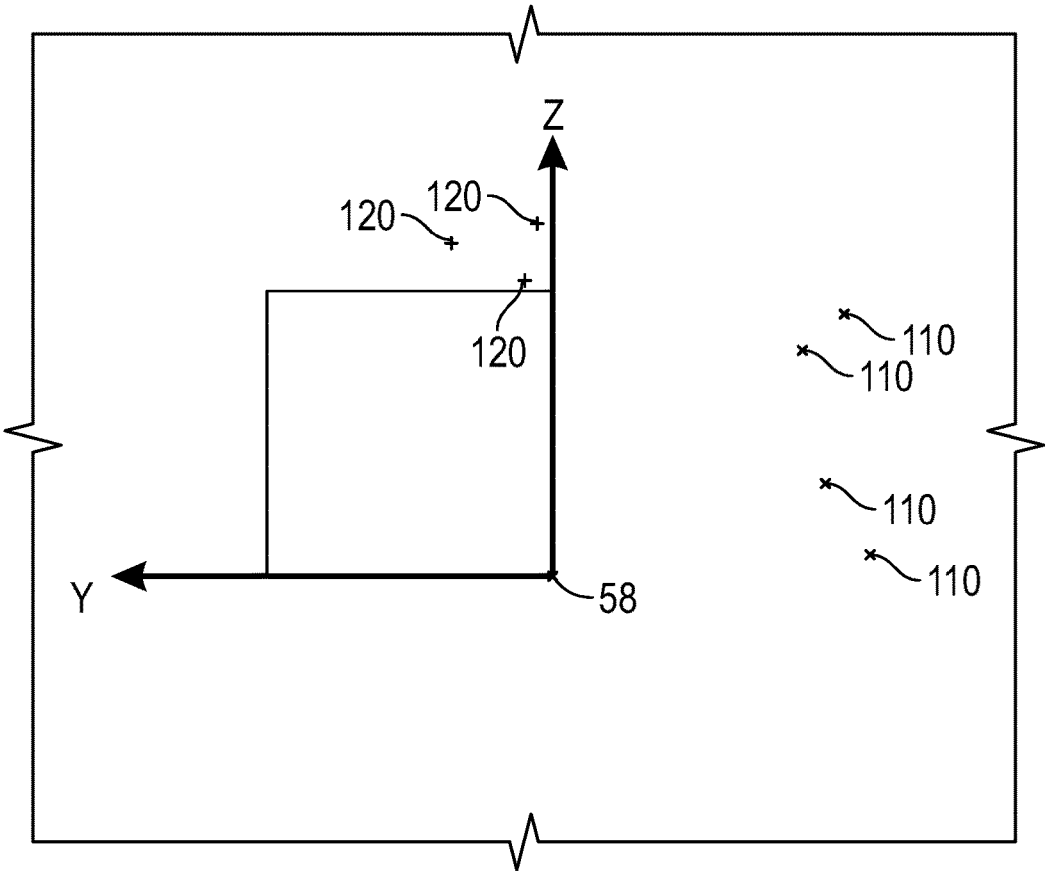
FIG. 16 is an enlarged view of the circled portion of the embodiment shown in FIG. 15.

As shown in FIGS. 15-16, including one or more of the embodiments shown in FIGS. 1-14 in an iron-type golf club head causes the center of gravity 105 to move toe-ward along the y axis and upward along the z axis with respect to a geometric face center 55. These Figures offer a comparison view of the centers of gravity measured from prior art iron-type golf club heads 110 and golf club heads 120 including the preferred embodiment of the present invention.

Any of the embodiments disclosed herein may be combined in an iron-type golf club head 10 to lighten and/or support the hosel 30 of the present invention. In any of the embodiments disclosed herein, the heel portion 29 of the body 20 (or other hollow portions of the body 20 or hosel 30) may be partially or completely filled with a dampening material 80, which may be polymeric (e.g., urethane or rubber) but preferably includes a wire mesh material, such as the material made by Kinetic Structures and described at the following website: http://www.kineticstructures.com/wire%20mesh%20friction%20damper.html.

In any of the embodiments disclosed herein, the hosel may be at least partially composed of a lightweight material, including but not limited to a thermoset matrix, a thermoplastic matrix, aluminum alloy, and/or magnesium alloy. The hosel cover may also be made of any of these materials.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. An iron-type golf club head comprising:
- a body comprising a top portion, a bottom portion, a heel portion, a toe portion, and a rear portion;
- a hosel comprising:
  - a tube body comprising a tube wall;
  - a bore;
  - a barrier;
- an interface between the body and the hosel; and
- at least one rib,
- wherein the at least one rib comprises a first rib and a second rib,
- wherein the first rib intersects the second rib,
- wherein the top portion, bottom portion, heel portion, toe portion, and rear portion define a hollow interior having an interior mold line,
- wherein the bore has a length of at least one inch and is disposed entirely within the tube body,
- wherein the interior mold line extends into the tube body above the interface,
- wherein the at least one rib is disposed within the hollow interior and extends into the tube body above the interface,
- wherein the barrier is disposed between and separates the bore and the interior mold line, and
- wherein the barrier does not comprise any through-holes.

2. The iron-type golf club head of claim 1, wherein the second rib is disposed at the interface.

3. The iron-type golf club head of claim 1, wherein the second rib is disposed above the interface.

4. An iron-type golf club head comprising:
- a body comprising a top portion, a bottom portion, a heel portion, a toe portion, and a rear portion;
- a hosel comprising:
  - a tube body comprising a tube wall;
  - a bore;
  - a barrier;
- an interface between the body and the hosel;
- a first rib; and
- a second rib,
- wherein the top portion, bottom portion, heel portion, toe portion, and rear portion define a hollow interior having an interior mold line,
- wherein the first rib is disposed within the hollow interior and extends into the tube body above the interface,
- wherein the first rib intersects the second rib,
- wherein the tube body comprises a first width proximate an upper edge of the tube body and a second width proximate the barrier,
- wherein the tube body width tapers gradually from the first width to the second width,
- wherein the interface has a wall thickness of 0.020 to 0.050 inch, and
- wherein the bore has a length of at least one inch and is disposed entirely within the tube body.

5. The iron-type golf club head of claim 4, further comprising a third rib, wherein the first rib intersects the third rib.

6. The iron-type golf club head of claim 5, wherein the third rib extends parallel with the second rib.

7. The iron-type golf club head of claim 6, wherein the second rib is disposed above the interface and wherein the third rib is disposed below the interface.

8. The iron-type golf club head of claim 4, wherein the first rib extends approximately perpendicular to the second rib.

9. The iron-type golf club head of claim 4, wherein the body is composed of a steel material.

10. The iron-type golf club head of claim 9, wherein the steel material is selected from the group consisting of 17-4, 450, 475, 1020, and 1025 steel.

* * * * *